US006769366B1

(12) United States Patent
Lydic et al.

(10) Patent No.: US 6,769,366 B1
(45) Date of Patent: Aug. 3, 2004

(54) ONE PIECE CENTER SILL FOR A RAILROAD CAR

(75) Inventors: Todd L. Lydic, Johnstown, PA (US); Tamo Bianchi, Oakville (CA); James A. Decker, Windber, PA (US)

(73) Assignee: JAC Patent Company, Johnstown, PA (US)

( * ) Notice: Subject to any disclaimer, the term of this patent is extended or adjusted under 35 U.S.C. 154(b) by 1243 days.

(21) Appl. No.: 08/712,369

(22) Filed: Sep. 11, 1996

(51) Int. Cl.[7] ..... B61D 17/00
(52) U.S. Cl. ..... 105/416
(58) Field of Search ..... 105/404, 396, 105/401, 409, 413, 414, 416, 417, 418, 419; 52/726.2, 730.4, 731.2, 732.1, 737.6, 737.3

(56) References Cited

U.S. PATENT DOCUMENTS 25,414 A * 9/1859 Jones ..... 52/737.6
785,781 A * 3/1905 Waggoner ..... 105/418
1,279,600 A * 9/1918 Slick ..... 105/418
1,360,774 A * 11/1920 Mooney et al. ..... 105/418
2,082,792 A * 6/1937 Dean ..... 105/416
4,254,714 A * 3/1981 Heap ..... 105/416
4,493,266 A * 1/1985 Augustine ..... 105/418
4,543,887 A * 10/1985 Baker ..... 105/416
4,580,388 A * 4/1986 Maisch ..... 52/737.6
4,986,051 A * 1/1991 Meyer et al. ..... 52/737.6
5,157,883 A * 10/1992 Meyer ..... 52/733.3

* cited by examiner

*Primary Examiner*—Mark T. Le
(74) *Attorney, Agent, or Firm*—BLK Law Group; Blynn L. Shideler; Krisanne Shideler

(57) ABSTRACT

A one-piece center sill for a railroad freight car formed by cold rolling a flat sheet of steel into a rectangular configuration. One of the embodiments includes strengthening flanges and another includes ribs.

14 Claims, 3 Drawing Sheets

ONE PIECE CENTER SILL FOR A RAILROAD CAR

BACKGROUND OF THE INVENTION

1. Field of the Invention

This invention relates in general to railroad cars and more specifically, to a one piece center sill and its method of manufacture.

2. Summary of the Prior Art

The center sill is the primary structural member of the underframe of a rail car. It is subjected to the buff and draft forces created during operation of the rail car and normally extends as a continuous member along the length of the car body. In the past, center sills have possessed many different cross-sectional configurations depending on the type of rail car and other considerations. Center sills have been in the shape of hat designs, C-sections and other configurations. Regardless of its particular shape, it is well known to form a center sill by welding a plurality of pieces together as a unit along its substantial length. The use of welds to manufacture center sills presents several long existing problems. Because welding is needed, the reliance on this process to fabricate a finished center sill is inefficient from both a cost and productivity standpoint. The application of the welds along the lengths of the pieces being joined as a center sill is labor intensive and cannot attain high-speed production. In addition, the application of multiple welds heats the material being joined and results in so-called weld flux. Weld flux creates deviations in the straightness or acceptable tolerances of the center sill being formed. As a result, further physical steps are needed to finish the welded center sill unit and conform it to acceptable tolerances in camber, sweep and twist to be suitable for use in a railroad car. As an additional important consideration, a welded center sill is an inherently heavy structure due to its design and fabrication technique. Accordingly, it is desirable in the prior art to provide an improved, light weight center sill in which the necessity of welds or other securement techniques are eliminated.

SUMMARY OF THE INVENTION

It is an objective of this invention to provide an improved single piece center sill capable of being cold formed into a straight member having close tolerances. The various configurations of the several embodiments of the invention are cold formed at a plurality of cold rolling stations from a plate or sheet of coiled steel. The flat sheet undergoes progressive formation at each rolling station whereby drawings of the steps of shaping developed by each roll station, when superimposed, form a flower diagram to assist the roll tooling designer. The center sills herein disclosed can be formed on a continuous basis without interruption between separate center sills. The unique cold forming process of the invention allows center sills having a thickness up to one-half inch to be formed without the use of welds as in the prior art. Because the bent sections forming the shape of the center sill are cold worked numerous times during working, the material is strengthened to produce a stronger cross-section without thicker sections or reinforcing material. The center sills are open at the bottom to provide desired access within the center sill body. Two of the configurations of the center sill include extra structural features that provide enhanced strength characteristics without adding significant weight.

DESCRIPTION OF THE PREFERRED EMBODIMENTS

Figure 1:
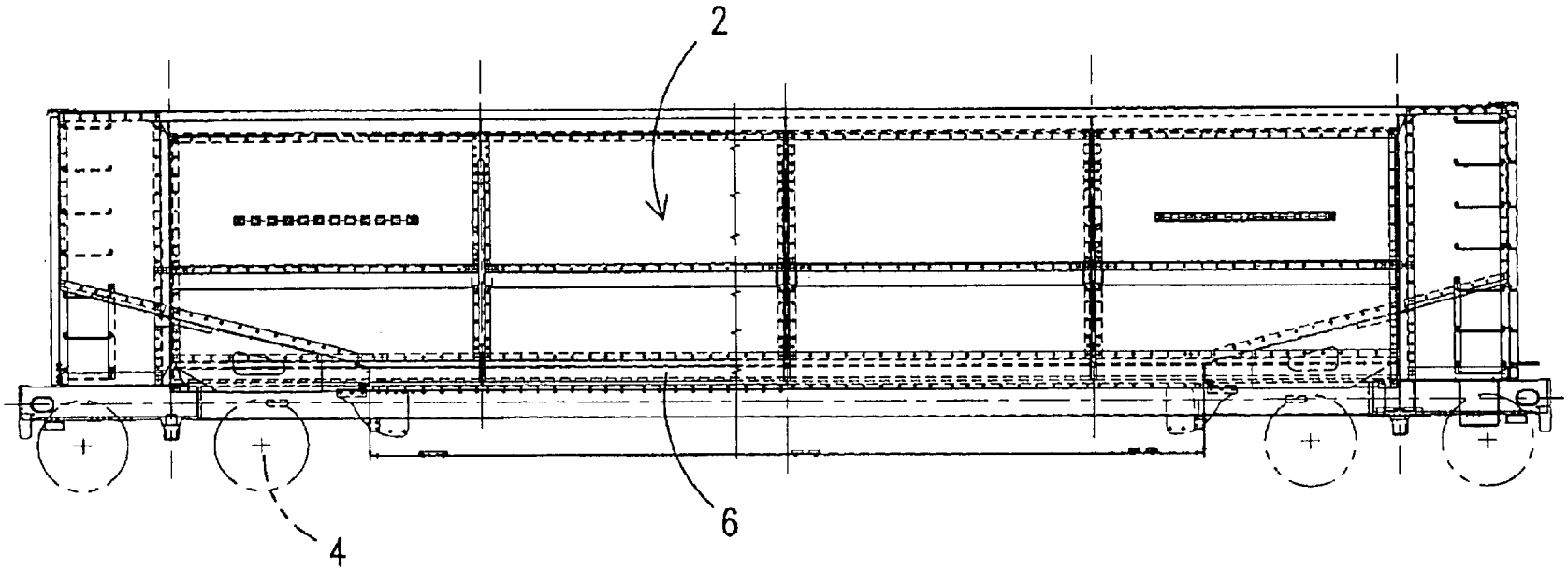
FIG. 1 is a side elevational view, with parts in section, showing any of the center sill embodiments of the invention on a gondola car.

Referring to FIG. 1, there is illustrated a railroad gondola car 2 for carrying commodities, such as coal, gravel and the like, and having a underbody carried by opposed truck assemblies 4. The underbody of the railroad car of the invention includes a continuous single piece center sill 6 extending substantially the entire length of the car. As will be apparent from the following description, the single piece center sills of several embodiments of the invention provide significant advantages over prior center sills and contribute to a lightweight, economical car design. Although the center sills of the invention are shown with reference to the gondola car of FIG. 1 by way of illustration, it is within the scope of the invention to use the single piece center sill herein disclosed with any type or design of rail freight car in which the advantages of the invention are desired.

Figure 2:
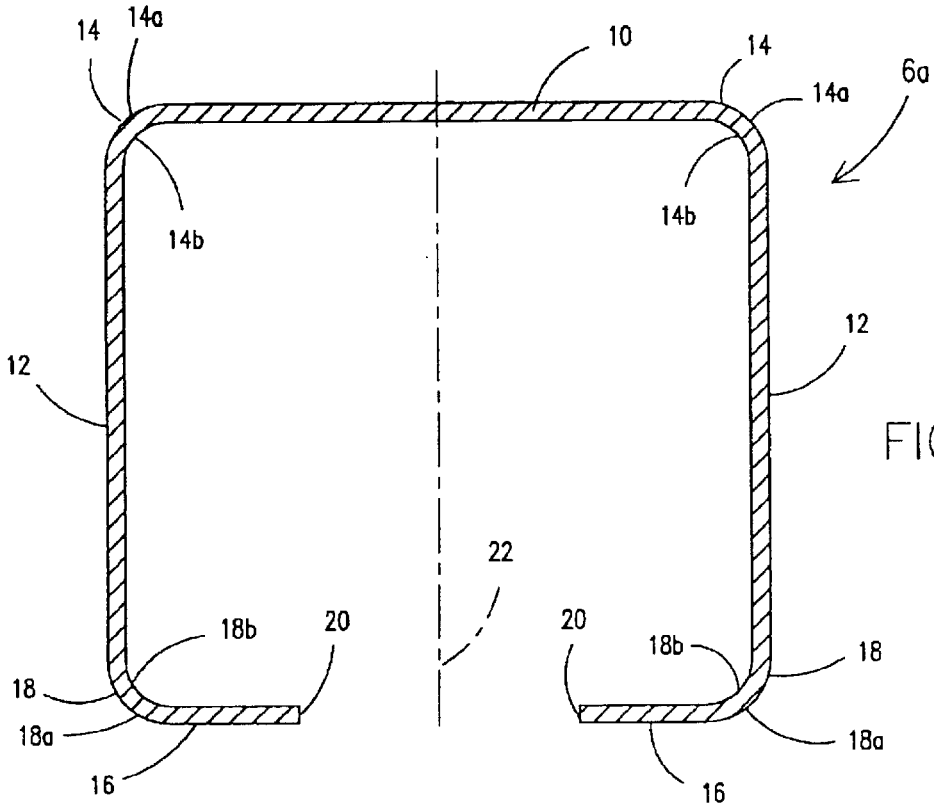
FIG. 2 is an end elevational view, with parts in section, of the cross-section of the first embodiment of the single piece center sill for use with the railroad car such as illustrated in FIG. 1.

Referring now to FIG. 2, there is illustrated the first embodiment of the single piece center sill of the invention, generally designated by reference numeral 6*a*. The center sill 6*a* of FIG. 2 is formed from a suitable steel by a cold rolling process to be described. The center sill 6*a* is formed in a generally rectangular configuration from a flat one piece plate or coiled sheet of steel and is continuous along its length. The center sill is formed by bent sections created in the cold forming process from a material having a thickness of up to ½ inch with thicknesses of either 0.35 inches to 0.5 inches being preferable. The center sill 6*a* includes an upper flat top wall 10 and a pair of flat side sections or webs 12, each of generally constant thicknesses.

The top wall 10 and pair of side sections 12 are joined together at right angles by upper curved sections 14 having curved outer surfaces 14*a* and curved inner surface 14*b*, the latter being formed about a common radius, such as, for example, 15/16 inches. The bottom sections 16 of the center sill 6*a* are inwardly formed horizontally at right angles to the side sections 12 through curved connecting sections 18 having curved outer surfaces 18*a* and curved inner surfaces 18*b*, the latter being of constant radius, such as, for example, approximately 15/16 inches. The bottom sections 16 terminate with a free ends 20 to form a longitudinal opening 22 through which access within the center sill 6*a* is provided. By way of example, the bottom sections 16 forming the bottom portions of the center sill may each extend approximately four inches from the side sections 12 and create the bottom opening 22 having a width of approximately five to six inches. The center sill 6*a* preferably possesses an average yield strength throughout its length of at least seventy thousand ksi and an average tensile strength of at least eighty thousand ksi to meet all strength requirements for the center sill. The curved sections 14 and 18 are cold worked numerous times during the colding rolling process. As a result, the material is cold hardened and strengthened at sections 14 and 18 as compared to its original unformed state. The resulting cross-section does not require thicker sections or added material as in the prior art and provide a lightweight, high strength member.

Figure 3:
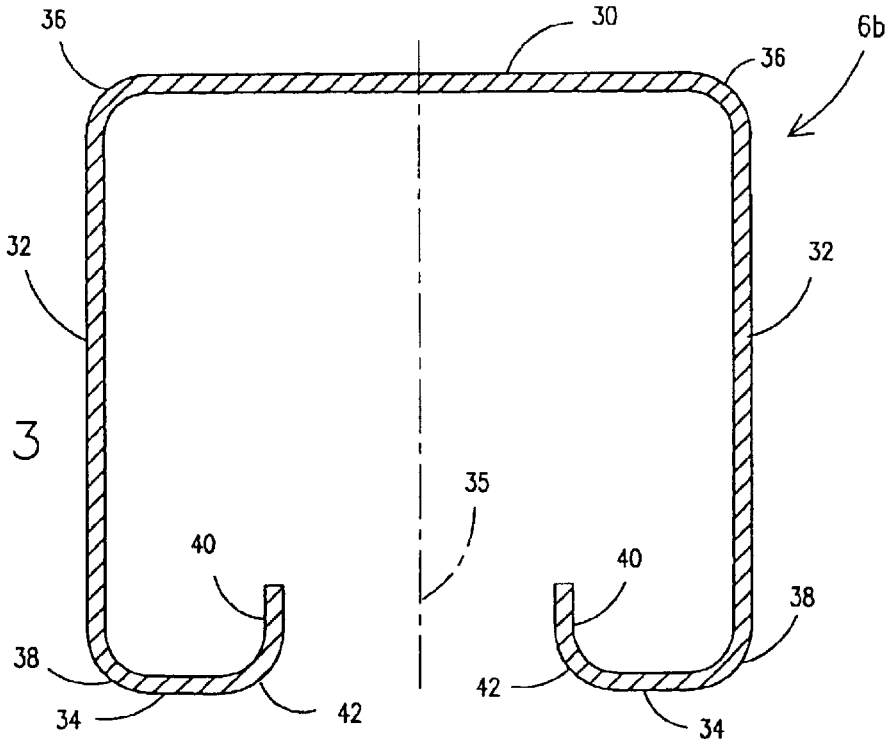
FIG. 3 is an end elevational view, with parts in section, of the cross-section configuration of a second embodiment of the single piece continuous center sill invention for use with a railroad car of the type shown in FIG. 1.

Referring to FIG. 3, there is illustrated the second embodiment of the center sill of the invention. The center sill 6*b* of FIG. 3 includes upper top wall 30, opposed side sections or webs 32 and bent in bottom portions 34 creating opening 35. The top walls 30, opposed side sections 32, and bottom portions 34 are respectively interconnected by upper curved sections 36 and lower curved sections 38 having a similar configuration as the embodiment of FIG. 2. As in the prior art, the curved sections 36 and 38 are cold hardened during rolling for increased strength. The center sill 6*b* further includes a pair of upright internal flange portions 40 extending upward and being joined to bottom portions 34 by curved sections 42 of constant radius similar as curved sections 36 and 38. The center sill 6*b* is cold formed in progressive steps as the previous embodiment to obtain its configuration, but initially from a wider sheet or plate material. The curved sections 42 are also cold hardened during rolling for increased strength. As a result, the cross-section of the center sill 6*b* includes more material for similar external dimensions than the configuration of the embodiment of FIG. 2 because of flange portions 40 to provide greater strength characteristics and high resistance to buckling, with only a minimum increase in weight. The thickness of center sill of FIG. 3 is preferably up to ½ inch, with 0.35 to 0.5 inches being preferred. The configuration exceeds the strength characteristics of the preceding embodiment for the same dimensions and material and is also continuously formed from a one piece coiled sheet or plate.

Figure 4:
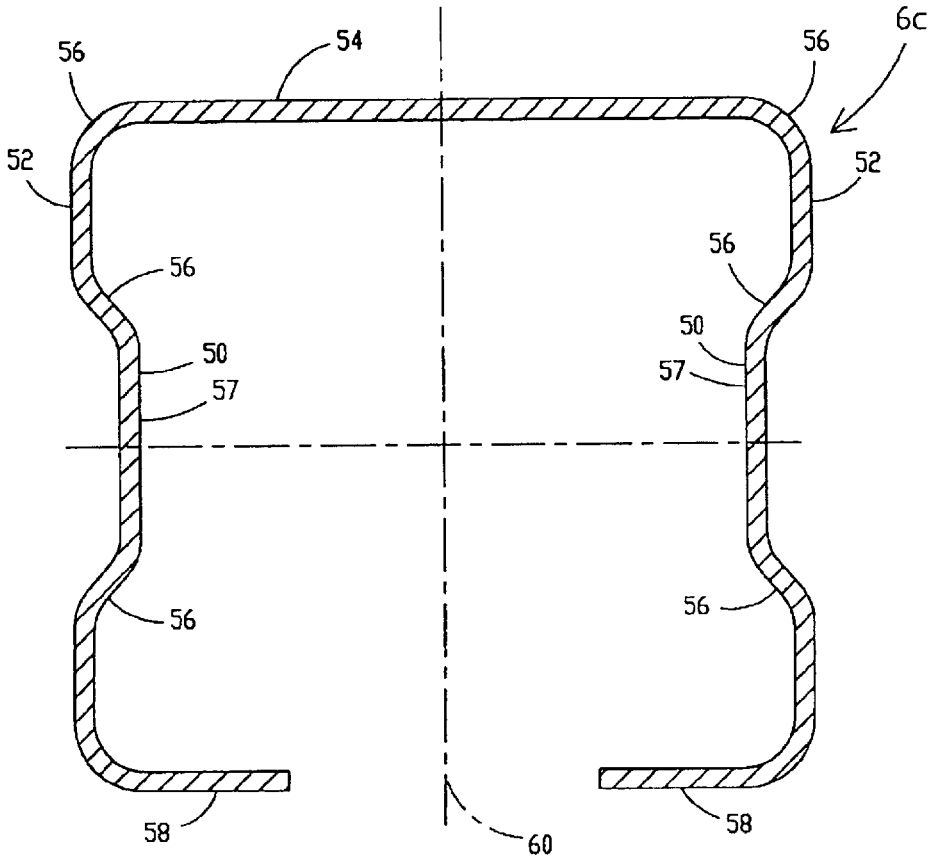
FIG. 4 is an end elevational view, with parts in section, of the cross-section configuration of a third embodiment of the single piece center sill of the invention for use with a car of the type shown in FIG. 1.

Referring now to FIG. 4, there is illustrated the third embodiment of the invention, generally designated by reference numeral 6*c*. The configuration of the center sill 6*c* is also similar to the embodiment of FIG. 2, but further includes a pair of inwardly disposed ribs 50 rolled out of the two side sections or webs 52 of the center sill 6*c*. The inwardly directed ribs 50 serve as stiffeners for the elongated center sill and are cold formed during the first stations in the rolling process. The center sill 6*c* includes a top wall 54 which is oriented at 90° to side sections 52 by a curved portion 56 having an approximate radius, for example, of 15/16 inches and the like. The ribs 50 include inwardly extending connecting portion 56 of a length less than an inch and have a flat internal wall 57 to rigidize the center sill. The connecting portion is also worked hardened as are curved portion 56. The bottom of the center sill includes a pair of partial horizontal bottom sections 58 integral to side sections 52 by curved sections 59. The bottom sections define longitudinal bottom opening 60 along the center sill 6*c*. Although other sizes and dimensions may be employed in accordance with the invention, the center sill 6*c* may have a width of approximately 1 foot 13/16 inches and a height of approximately 1 foot, 15/16 inches and the like. The embodiments described with reference to FIGS. 2 and 3 may have similar or external dimensions. The internal wall 57 of the ribs 50 may extend for a height of three to four inches or other suitable dimension. The bottom sections 58 may extend for approximately 4 inches at the bottom. The center sill 6*c* is cold formed from a steel having a tensile strength of at least 70 ksi. Center sill 6*c* provides additional bending and buckling strength due to the presence of the stiffening ribs 50 for the same size and material as compared to the embodiment of FIG. 2, but only adds minimal weight to the overall structure of the beam.

Figure 5:
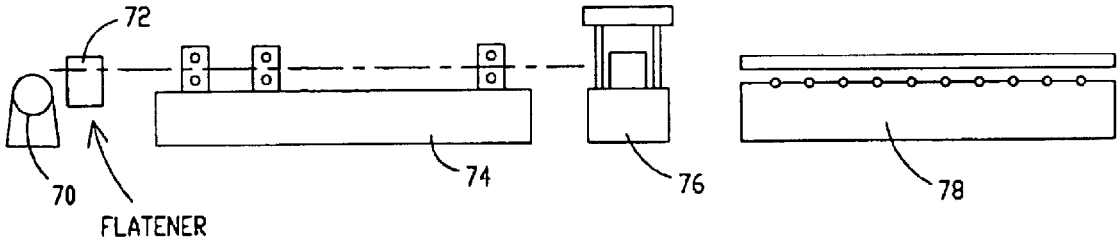
FIG. 5 is a schematic diagram of the cold forming process for forming the cold formed continuous center sill of the several embodiments of the invention.

Referring now to FIG. 5, a schematic view of the technique of cold rolling the various embodiments of the center sill of the invention is illustrated. Coiled steel in sheet form is carried by a conventional uncoiler 70. In the embodiment of FIG. 2, the width of the coiled metal may be, for example, forty-six inches. As is well known, the stations of the rolling mill 74 comprise roll formers positioned at different orientations at each station to cause the progressive deformation of the sheet material into the desired configuration. During the initial set up of the process, the steel coil is opened and fed through a flattener apparatus 72 to remove coil set. The lead end of the coil is trimmed and joined to the trailing end of the previous length of material in a shear welder. The plate or sheet material is fed to a forming mill 74 comprising ten or more pairs of roll forming stations to progressively form the flat material into the finished shape as shown in FIGS. 2, 3 and 4.

In the formation of the embodiment of FIG. 2, the flat plate or sheet material undergoes bending at a plurality of stations, such as ten or more, that create the final cold formed shape of the center sill of FIG. 2 to be formed. In connection with the embodiment of FIG. 3, added stations are required for first several steps to form the bent up internal flange portions 40. As to the embodiment of FIG. 4, the rib sections 50 are also formed during the first several steps of the rolling process during passage of the sheet material through the rolling mill 74.

After the final station in rolling mill 74 is passed, the formed single piece center sill is delivered to a cut-off press 76 which cuts the center sill to the desired length without stopping the rolling process. The separated center sill then is conveyed to a conveyor 78 on which the profile of the center sill is inspected to determine whether its dimensions are correct and whether acceptable tolerances of camber, sweep, and twist have been maintained. The cold forming process of the invention attains significantly close tolerances in the final product of the center sill by a process that is capable of high production with minimum labor. This capability provides a vastly superior product with economical manufacture and a beam structure of high quality and precise shape. The single piece center sill of the invention is lightweight, being approximately 1,000 pounds or more lighter than conventional welded sills.

Superior strength characteristics of the center sill of the invention are attained by using a steel, such as an ASTM A607, grade 70 for a plate or sheet having a thickness ⅜ inches. With a thicker sheet of material, such as ½ inches, an ASTM A607, grade 50 steel may be used with coiled plate or a ASTM A572, grade 50 with a coiled sheet. One suitable ASTM A607, grade 70 steel for thicknesses of ⅜ inches is known as Type 1, sold under the trademark Stelmax 70. Stelmax 70 has an expected yield strength of 76 ksi and a tensile strength of 86 ksi. Other steels of the type described demonstrating similar properties may be used with the invention.

What is claimed is:

1. A center sill for a railroad car comprising a cold formed center sill, said center sill being formed from a single flat member of material, wherein said center sill includes a cross-section having a generally hollow, rectangular configuration, and an open bottom, wherein said open bottom is formed by a pair of horizontal portions having spaced longitudinal edges, and wherein said horizontal portions include generally vertical flanges formed along said longitudinal edges.

2. The center sill according to claim 1 wherein said single flat member is steel having a yield strength of at least 70 ksi.

3. The center sill according to claim 1 wherein said vertical flanges extend into said center sill.

4. The center sill according to claim 1 wherein said center will includes a top wall, a pair of side walls and a pair of lower bottom sections to form a longitudinal opening of said open bottom, said top wall and said side wall being interconnected by first work hardened interconnecting sections, said side walls and said lower bottom portions being second work hardened interconnecting sections.

5. The center sill according to claim 4 wherein said first interconnecting sections and said second interconnecting sections are curved sections forming said generally rectangular configuration.

6. The center sill according to claim 1 wherein said center sill has a generally constant thickness.

7. The center sill according to claim 6 wherein said constant thickness is in the ranges of 0.35" to 0.5".

8. A center sill for a railroad car comprising a cold formed center sill, said center sill being formed from a single fat member of material, wherein said center sill includes a cross-section having a generally hollow, rectangular configuration, and wherein said center sill includes opposed side walls, said side walls including longitudinal ribs.

9. The center sill according to claim 8 wherein said ribs are bent inward from said side walls.

10. A beam for use with the underframe of a vehicle comprising a one-piece cold formed steel member having a hollow elongated body, and said body having a generally rectangular configuration, wherein said one-piece steel body is formed from a flat steel member by cold forming, and wherein said beam includes an upper wall, a pair of side walls and a pair of bottom portions forming a longitudinal opening, said upper wall, said pair of side walls and said bottom horizontal portions having a constant thickness of material, and wherein said upper wall, said pair of side walls and said bottom portions are respectively interconnected by curved portions, said curved portions being cold hardened during said cold working process, and further including vertical flange portions extending from said horizontal bottom portions.

11. The beam according to claim 10 wherein side walls include longitudinally extending ribs.

12. A center sill for use with the under frame of a railroad car, said center sill comprising a steel member having a hollow elongated body, said body having a generally rectangular configuration, wherein said body includes an upper wall, a pair of side walls, and a pair of bottom portions forming a longitudinal opening, and wherein said upper wall, said pair of side walls and said bottom portions are respectively interconnected by cold hardened curved portions, said curved portions being cold hardened during a cold forming process, and further including vertically extending flanges spaced from said pair of side walls extending from said bottom portions on opposed sides of said longitudinal opening.

13. The center sill of claim 12 wherein said body has a strength of at least 50 ksi and a thickness of at least ⅜ of an inch.

14. The center sill of claim 12 wherein said center sill has a substantially constant thickness.

* * * * *